US007808452B2

(12) United States Patent
Shoji et al.

(10) Patent No.: US 7,808,452 B2
(45) Date of Patent: Oct. 5, 2010

(54) PLASMA DISPLAY PANEL DRIVING METHOD AND PLASMA DISPLAY DEVICE

(75) Inventors: Hidehiko Shoji, Osaka (JP); Takahiko Origuchi, Osaka (JP)

(73) Assignee: Panasonic Corporation, Osaka (JP)

( * ) Notice: Subject to any disclaimer, the term of this patent is extended or adjusted under 35 U.S.C. 154(b) by 767 days.

(21) Appl. No.: 11/662,494

(22) PCT Filed: Jul. 14, 2006

(86) PCT No.: PCT/JP2006/314032

§ 371 (c)(1),
(2), (4) Date: Mar. 15, 2007

(87) PCT Pub. No.: WO2007/007871

PCT Pub. Date: Jan. 18, 2007

(65) Prior Publication Data

US 2008/0252562 A1 Oct. 16, 2008

(30) Foreign Application Priority Data

Jul. 14, 2005 (JP) ..... 2005-205292

(51) Int. Cl.
*G09G 3/28* (2006.01)

(52) U.S. Cl. ..... 345/63; 345/60

(58) Field of Classification Search ..... 345/60–72; 315/169.4, 169.3
See application file for complete search history.

(56) References Cited

U.S. PATENT DOCUMENTS 6,294,875 B1 9/2001 Kurata et al.
6,340,867 B1 * 1/2002 Kang ..... 315/169.4
6,507,327 B1 * 1/2003 Atherton et al. ..... 345/68
2002/0041161 A1 4/2002 Setoguchi et al.
2002/0053882 A1 * 5/2002 Kanazawa et al. ..... 315/169.3
2005/0116885 A1 * 6/2005 Sasaki et al. ..... 345/60
2005/0128166 A1 * 6/2005 Tanaka et al. ..... 345/60
2005/0162345 A1 * 7/2005 Kwon et al. ..... 345/60
2005/0264230 A1 * 12/2005 Kim et al. ..... 315/169.4
2005/0264476 A1 * 12/2005 Kim et al. ..... 345/60

(Continued)

FOREIGN PATENT DOCUMENTS

CN 1271158 10/2000

(Continued)

*Primary Examiner*—Amare Mengistu
*Assistant Examiner*—Gene W Lee
(74) *Attorney, Agent, or Firm*—Wenderoth, Lind & Ponack, L.L.P.

(57) ABSTRACT

A method for driving a plasma display panel including discharge cells at the intersections of data electrodes D1 to Dm and pairs of scan electrodes SC1 to SCn and sustain electrodes SU1 to SUn. One field period is composed of a plurality of subfields each including a writing period and a sustain period. During the writing period, a writing discharge is generated in a selected one of the discharge cells. During the sustain period, a sustain discharge is generated in the selected discharge cell. A voltage to be applied to sustain electrodes SU1 to SUn in the writing period of the subfield having the lowest display luminance of all the subfields is set higher than a voltage to be applied to sustain electrodes SU1 to SUn in the writing period of the subfields other than the subfield having the lowest display luminance.

2 Claims, 6 Drawing Sheets

U.S. PATENT DOCUMENTS

| | | | | |
|---|---|---|---|---|
| 2006/0187147 | A1* | 8/2006 | Jeong | 345/63 |
| 2006/0238453 | A1* | 10/2006 | Myoung et al. | 345/67 |

FOREIGN PATENT DOCUMENTS

| | | |
|---|---|---|
| CN | 1355518 | 6/2002 |
| JP | 2000-242224 | 9/2000 |
| JP | 2000-261739 | 9/2000 |
| JP | 2005-37606 | 2/2005 |
| KR | 2005-0113837 | 12/2005 |

* cited by examiner

PLASMA DISPLAY PANEL DRIVING METHOD AND PLASMA DISPLAY DEVICE

This application is a U.S. National Phase Application of PCT International Application PCT/JP2006/314032.

BACKGROUND OF THE INVENTION

1. Field of Invention

The present invention relates to a plasma display device and a method for driving a plasma display panel.

2. Description of the Related Art

An AC surface discharge type panel, which is a typical plasma display panel (hereinafter, abbreviated as a "panel") includes a front plate and a rear plate disposed opposite to each other and a plurality of discharge cells formed between these plates. The front plate includes a plurality of parallel-arranged display electrodes, each composed of a pair of a scan electrode and a sustain electrode which are formed on a front glass substrate and coated with a dielectric layer and further with a protective layer. The rear plate includes a plurality of parallel-arranged data electrodes which are formed on a rear glass substrate and coated with a dielectric layer. The rear plate further includes a plurality of barrier ribs formed on the dielectric layer in parallel with the data electrodes. The surface of the dielectric layer and side surfaces of the barrier ribs are coated with phosphor layers. The front plate and the rear plate are disposed opposite to each other in such a manner that the display electrodes three-dimensionally intersect with the data electrodes and that the discharge space between the plates is filled with a discharge gas. The display electrodes and the data electrodes intersect with each other to form discharge cells therebetween. In a panel having such a structure, a gas discharge in each discharge cell generates ultraviolet light, which excites R, G, and B phosphors for color display.

The panel can be driven by subfield methods, by which one field period is divided into a plurality of subfields, and in each subfield, each discharge cell is controlled to emit or not to emit light so as to achieve gradation display. Each subfield consists of an initialization period, a writing period, and a sustain period. In the initialization period, an initialization discharge is generated in each discharge cell so as to form a wall charge necessary for writing operation. In addition, priming (a discharge initiator=excited particles) is generated so as to reduce a discharge delay and stabilize the generation of a writing discharge. In the writing period, the scan electrodes are sequentially applied with scan pulses, and the data electrodes are applied with a write pulse corresponding to the signal of an image to be displayed. Applying the pulses in this manner allows selective writing discharges between the scan electrodes and the data electrodes, thereby forming wall charges only by selected discharge cells. In the subsequent sustain period, the sustain pulse is applied a predetermined number of times between the scan electrodes and the sustain electrodes in accordance with the display luminance. Then, only the discharge cells, which have formed wall charges by the writing discharges, are discharged to emit light. The display luminance ratio of the plurality of subfields is called "luminance weight".

Japanese Patent Unexamined Publication No. 2000-242224 discloses several such subfield methods in order to minimize the emission irrelevant to gradation display, thereby improving the contrast ratio. One method is to generate an initialization discharge using a slowly changing voltage waveform, and another is to generate an initialization discharge only in the discharge cell in which a sustain discharge has been generated.

However, reducing the emission due to the initialization discharge irrelevant to gradation display tends to reduce the priming effect. This makes it more likely to have a discharge cell that does not emit light in spite of the application of a write pulse (hereinafter abbreviated as an "unlit cell") when displaying low gradation levels. Such an unlit cell is caused particularly when a discharge cell to be emitted is isolated with no other discharge cells to be emitted in vicinity as in a subfield that has been subjected to an error diffusion process.

BRIEF SUMMARY OF THE INVENTION

The present invention, which has been devised in view of the above-described problems, provides a method for driving a panel that has a low probability of unlit cells when displaying low gradation levels and has excellent image display quality.

A method for driving a panel according to the present invention is described below. The panel includes discharge cells at intersections of a data electrode and a pair of a scan electrode and a sustain electrode, wherein one field period is composed of a plurality of subfields each including a writing period during which a writing discharge is generated in a selected one of the discharge cells, and a sustain period during which a sustain discharge is generated in the selected discharge cell. The method includes applying a voltage to the sustain electrode in the writing period of the subfield having the lowest display luminance of the plurality of subfields, such that the voltage is set higher than a voltage to be applied to the sustain electrode in the writing period of the other subfields.

The method according to the present invention may include driving a panel including discharge cells at the intersections of a data electrode and a pair of a scan electrode and a sustain electrode, wherein one field period is composed of a plurality of subfields each including a writing period during which a writing discharge is generated in a selected one of the discharge cells, and wherein a sustain period during which a sustain discharge is generated in the selected discharge cell. The method may include applying the write pulse voltage to the data electrode in the writing period of a subfield having the lowest display luminance of the plurality of subfields, such that the voltage is set higher than the write pulse voltage to be applied to the data electrode in the writing period of the other subfields.

The method according to the present invention may include driving a panel including discharge cells at the intersections of a data electrode and a pair of a scan electrode and a sustain electrode, wherein one field period is composed of a plurality of subfields each including a writing period during which a writing discharge is generated in a selected one of the discharge cells, and wherein a sustain period during which a sustain discharge is generated in the selected discharge cell. The method may include applying the scan pulse voltage to the scan electrode in the writing period of a subfield having the lowest display luminance of the plurality of subfields, such that the voltage is set higher than the scan pulse voltage to be applied to the scan electrode in the writing period of the other subfields.

In this manner, the present invention provides a method for driving a panel that that has a low probability of unlit cells when displaying low gradation levels and has excellent image display quality.

DETAILED DESCRIPTION OF THE INVENTION

A panel driving method according to an embodiment of the present invention is described as follows with reference to drawings.

Figure 1:
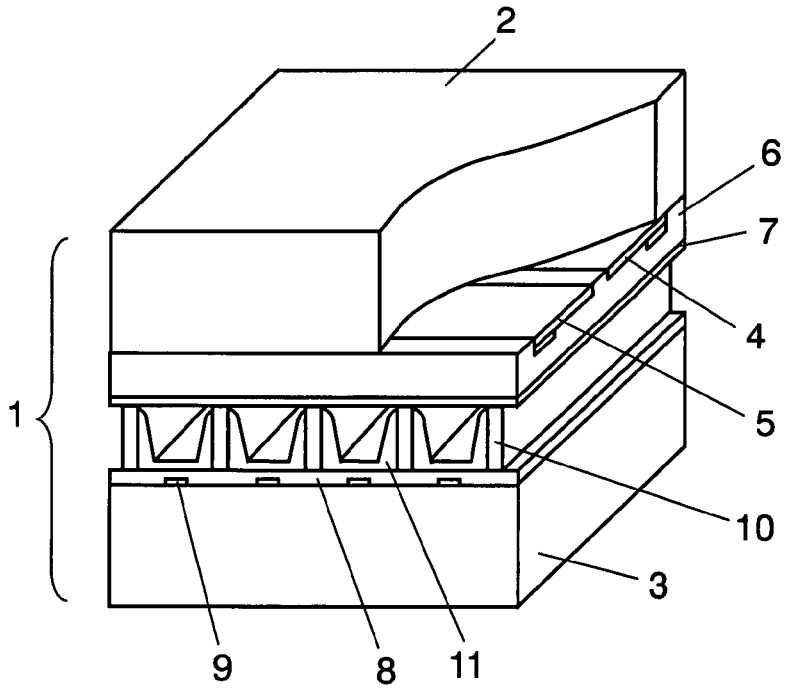
FIG. 1 is a perspective view of an essential part of a panel according to an embodiment of the present invention.

FIG. 1 is a perspective view of an essential part of a panel according to an embodiment of the present invention. Panel 1 includes front substrate 2 and rear substrate 3 which are made of glass and disposed opposite to each other with a discharge space therebetween. Front substrate 2 is provided with parallel-arranged pairs of scan electrodes 4 and sustain electrodes 5 so as to form display electrodes. Scan electrodes 4 and sustain electrodes 5 are coated with a dielectric layer 6, which is further coated with protective layer 7. Rear substrate 3 is provided with a plurality of data electrodes 9 coated with insulating layer 8, on which barrier ribs 10 are formed in parallel with data electrodes 9. The surface of insulating layer 8 and side surfaces of barrier ribs 10 are provided with phosphor layers 11. Front and rear substrates 2 and 3 are disposed opposite to each other in such a manner as to have a discharge space therebetween and to make scan electrodes 4 and sustain electrodes 5 intersect with data electrodes 9. The discharge space is filled with a mixture of, for example, neon and xenon gases as a discharge gas. The panel may have other structures, for example, the barrier ribs may be arranged in a grid pattern.

Figure 2:
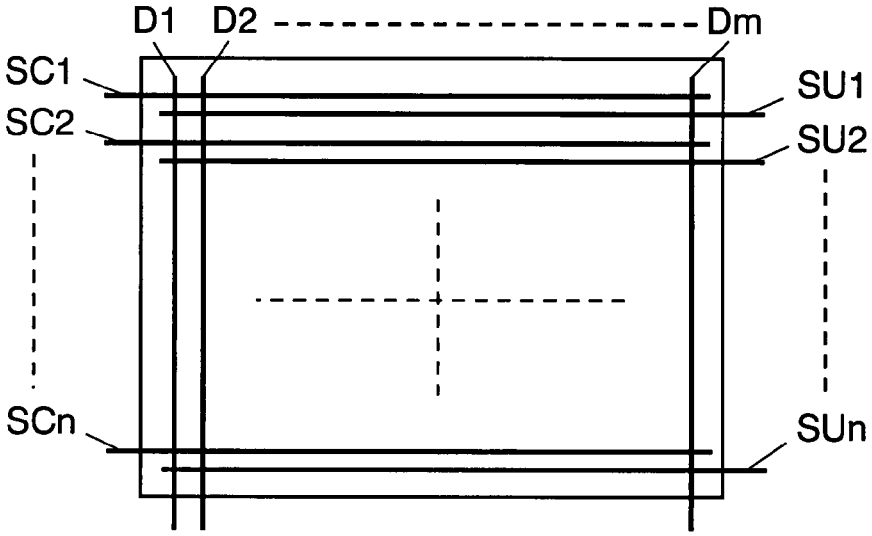
FIG. 2 shows an electrode array in the panel according to the embodiment.

FIG. 2 shows an electrode array in the panel according to the embodiment. In the row direction, n scan electrodes SC1 to SCn (scan electrodes 4 of FIG. 1) and n sustain electrodes SU1 to SUn (sustain electrodes 5 of FIG. 1) are arranged. In the column direction, m data electrodes D1 to Dm (data electrodes 9 of FIG. 1) are arranged. At each intersection of one pair of scan electrode SCi and sustain electrode SUi (i=1 to n) with one data electrode Dj (j=1 to m), a discharge cell is formed. As a result, a total of m×n discharge cells are formed in the discharge space.

Figure 3:
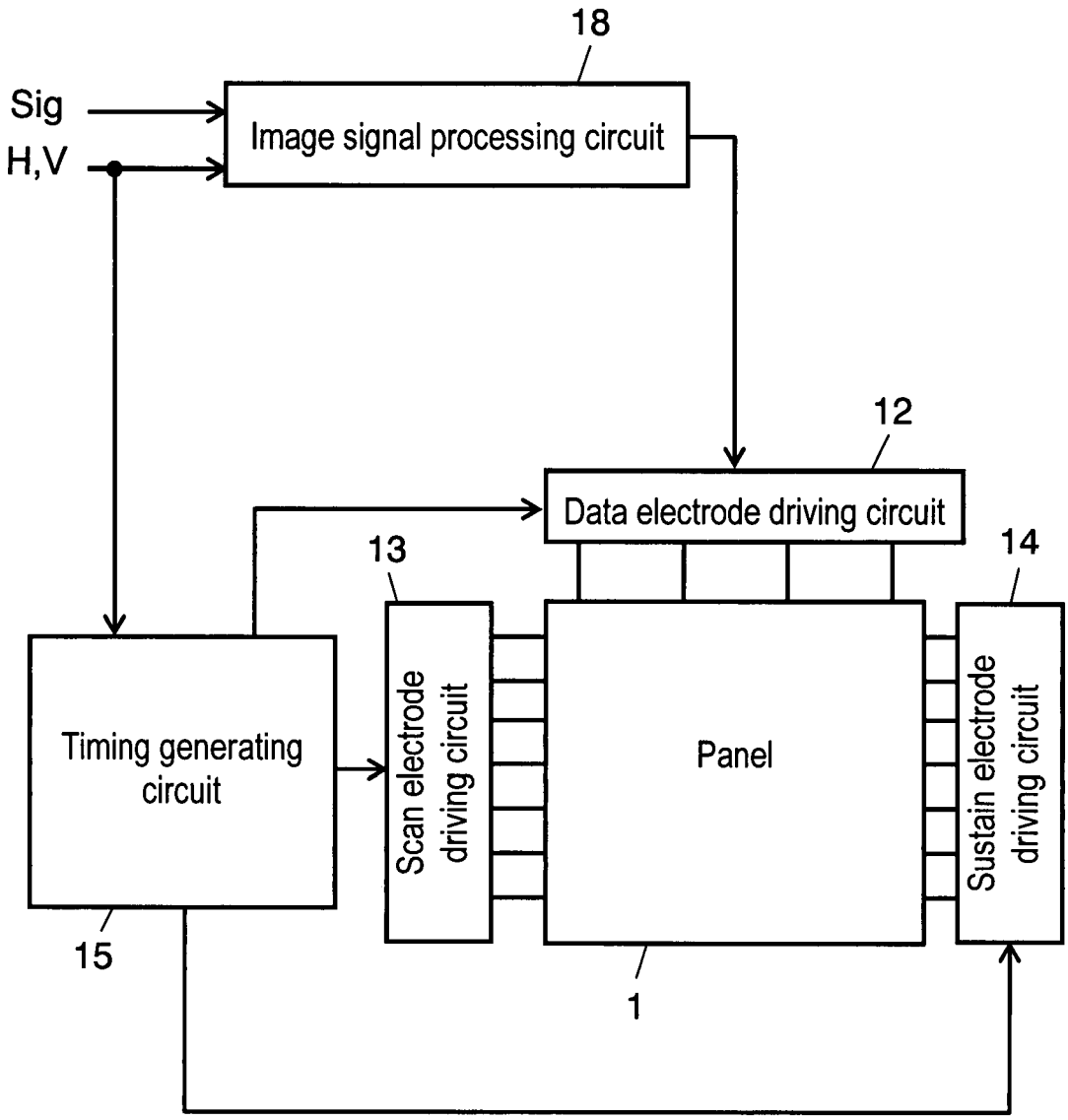
FIG. 3 is a circuit diagram of a plasma display device using a method for driving the panel according to the embodiment.

FIG. 3 is a circuit diagram of a plasma display device using a method for driving the panel according to the embodiment. The plasma display device includes panel 1, data electrode driving circuit 12, scan electrode driving circuit 13, sustain electrode driving circuit 14, timing generating circuit 15, image signal processing circuit 18, and a power supply circuit (unillustrated). Image signal processing circuit 18 converts an image signal "sig" to image data corresponding to the number of pixels of panel 1, divides the image data for each pixel into a plurality of bits corresponding to a plurality of subfields, and outputs the bits to data electrode driving circuit 12. Data electrode driving circuit 12 converts the image data for each subfield to a signal corresponding to each of data electrodes D1 to Dm so as to drive data electrodes D1 to Dm. Timing generating circuit 15 generates timing signals based on horizontal synchronizing signal "H" and vertical synchronizing signal "V" and supplies them to the driving circuit blocks. Scan electrode driving circuit 13 provides scan electrodes SC1 to SCn with driving waveforms based on a timing signal, and sustain electrode driving circuit 14 provides sustain electrodes SU1 to SUn with driving waveforms based on another timing signal.

The following is a description of the drive voltage waveforms to drive the panel and the driving operation. In the present embodiment, one field is divided into ten subfields (the first SF, the second SF, . . . , and the tenth SF), and these subfields have a luminance weight of 1, 2, 3, 6, 11, 18, 30, 44, 60, and 80, respectively. In the present embodiment, each subfield has a luminance weight not higher than the luminance weight of the subfield arranged later. The first SF has the lowest display luminance.

Figure 4:
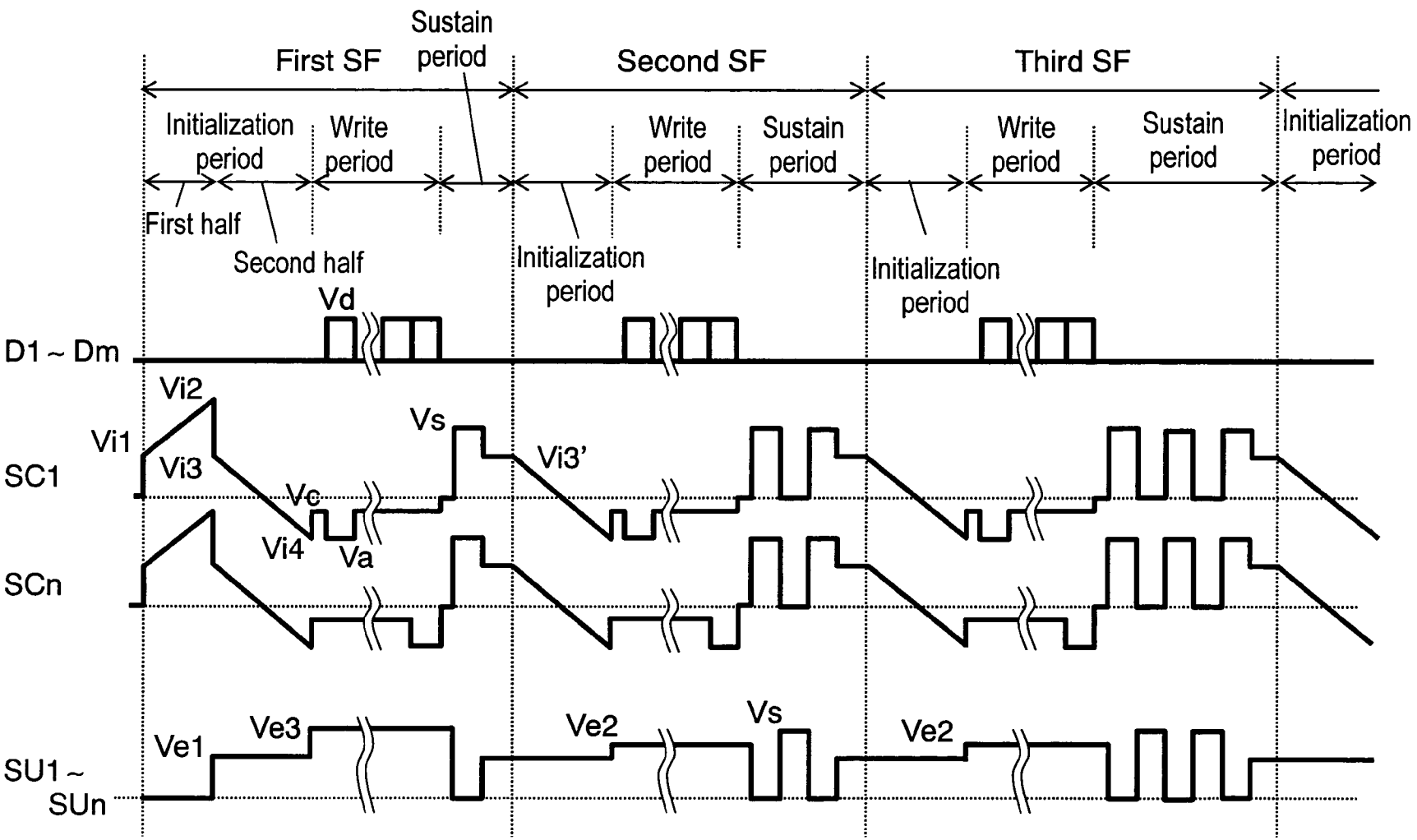
FIG. 4 shows drive voltage waveforms to be applied to the electrodes in the panel according to the embodiment.

FIG. 4 shows drive voltage waveforms to be applied to the electrodes in the panel according to the embodiment.

In the first half of the initialization period of the first subfield having the lowest display luminance, data electrodes D1 to Dm and sustain electrodes SU1 to SUn are held at 0V, and scan electrodes SC1 to SCn are subjected to a ramp voltage gradually increasing from voltage Vi1 to reach voltage Vi2. Voltage Vi1 is not more than the discharge starting voltage, and voltage Vi2 exceeds the discharge starting voltage. As a result, a first weak initialization discharge is generated in all the discharge cells so as to store negative wall voltages on scan electrodes SC1 to SCn and positive wall voltages on sustain electrodes SU1 to SUn and on data electrodes D1 to Dm. Here, the wall voltages stored on the electrodes indicate voltages generated by wall charges accumulated on the dielectric layer or the phosphor layers which coat the electrodes.

In the second half of the initialization period, scan electrodes SC1 to SCn are subjected to a ramp voltage gradually decreasing from voltage Vi3 to reach voltage Vi4, while sustain electrodes SU1 to SUn are being held at positive voltage Ve1. As a result, a second weak initialization discharge is generated in all the discharge cells so as to weaken the wall voltages on scan electrodes SC1 to SCn and on sustain electrodes SU1 to SUn. This results in the adjustment of the wall voltages on data electrodes D1 to Dm to values appropriate for writing operation.

Voltages Vi1, Vi2, Vi3, Vi4, and Ve1 in the present embodiment are set to 180V, 320V, 180V, −120V, and 150V, respectively. Alternatively, however, these voltage values can be set appropriately based on the characteristics of discharge of the discharge cells.

In the writing period of the first SF having the lowest display luminance, sustain electrodes SU1 to SUn are applied with voltage Ve3, and scan electrodes SC1 to SCn are once held at voltage Vc. Then, of data electrodes D1 to Dm, data electrode Dk (k=1 to m) of the discharge cell that is to emit light on the first row is applied with positive write pulse voltage Vd, and scan electrode SC1 on the first row is applied with negative scan pulse voltage Va. In this case, the intersection of data electrode Dk and scan electrode SC1 has a voltage equal to the total of an externally applied voltage (Vd−Va), the wall voltage on data electrode Dk, and the wall voltage on scan electrode SC1, the total exceeding the discharge starting voltage. Writing discharges are generated between scan electrode SC1 and data electrode Dk and between scan electrode SC1 and sustain electrode SU1. In the discharge cell formed by scan electrode SC1, sustain electrode SU1, and data electrode Dk, a positive wall voltage is accumulated on scan electrode SC1, and a negative wall voltage is accumulated on sustain electrode SU1 and also on data electrode Dk. Thus, the writing discharge is generated in the discharge cell that is to emit light on the first row, thereby performing a writing operation to accumulate a wall voltage on each electrode. On the other hand, the intersections of data electrode Dh (h≠k) that has not been applied with positive write pulse voltage Vd and scan electrode SC1 have a voltage not exceeding the discharge starting voltage, so that no writing discharge is generated. The above-described writing operation is applied to the discharge cells row by row up to the nth row so as to terminate the writing period.

Voltages Ve3, Vc, Vd, and Va in the present embodiment are set to 160V, 20V, 70V, and −120V, respectively; alternatively, however, these voltage values can be set appropriately based on the characteristics of discharge of the discharge cells.

It should be noted that voltage Ve3 is set higher than voltage Ve1 by about 10V, and it should particularly be noted that voltage Ve3 is set higher than later-described voltage Ve2, which is the voltage to be applied to sustain electrodes SU1 to SUn in the writing period of the subfields other than the subfield having the lowest display luminance. In the present embodiment, voltage Ve3 is set higher than voltage Ve2 by about 5V.

In the subsequent sustain period, sustain electrodes SU1 to SUn are set back to 0V, and scan electrodes SC1 to SCn are applied with the initial sustain pulse voltage Vs. In the discharge cell, in which the writing discharge has been generated, the voltage applied between scan electrode SCi and sustain electrode SUi is equal to the total of sustain pulse voltage Vs, the wall voltage on scan electrode SCi, and the wall voltage on sustain electrode SUi, the total exceeding the discharge starting voltage. Then, scan electrode SCi and sustain electrode SUi generate a sustain discharge therebetween and emit light. As a result, a negative wall voltage is accumulated on scan electrode SCi, and a positive wall voltage is accumulated on sustain electrode SUi and on data electrode Dk. In the discharge cell in which no writing discharge has been generated in the writing period, no sustain discharge occurs, so that the wall voltage condition at the end of the initialization period is maintained.

In the sustain period of the first SF in FIG. 4, a single sustain pulse is applied. Alternatively, however, more than one sustain pulse may be applied if necessary. In that case, scan electrodes SC1 to SCn are set back to 0V following the application of the first sustain pulse, and sustain electrodes SU1 to SUn are applied with second sustain pulse voltage Vs. In the discharge cell in which the sustain discharge has been generated, the voltage applied between sustain electrode SUi and scan electrode SCi exceeds the discharge starting voltage. This causes another sustain discharge between sustain electrode SUi and scan electrode SCi. As a result, a negative wall voltage is accumulated on sustain electrode SUi, and a positive wall voltage is accumulated on scan electrode SCi. Hereinafter, in the same manner, the necessary number of sustain pulses are applied to scan electrodes SC1 to SCn and sustain electrodes SU1 to SUn. This allows the discharge cell in which the writing discharge has been generated in the writing period to have a sustain discharge in the sustain period. In this manner, the sustain operation in the sustain period is terminated.

Voltage Vs is set to 180V in the present embodiment. However, the voltage value can be set appropriately based on the characteristics of discharge of the discharge cells.

In the initialization period of the second SF, sustain electrodes SU1 to SUn are held at voltage Ve1, data electrodes D1 to Dm are held at a ground potential, and scan electrodes SC1 to SCn are subjected to a ramp voltage gradually decreasing from voltage Vi3' to reach voltage Vi4. As a result, a weak initialization discharge is generated in the discharge cell in which the sustain discharge has been generated in the sustain period of the previous subfield. This weakens the wall voltage on scan electrode SCi and on sustain electrode SUi, thereby adjusting the wall voltage on data electrode Dk to a value suitable for the writing operation. On the other hand, no discharge is generated in the discharge cell in which no writing and sustain discharges have been generated in the previous subfield. As a result, the wall voltage condition at the end of the initialization period is maintained. The initialization operation of the second SF is described as selective initializing operation in the present embodiment. Alternatively, however, it may be all-cell initializing operation.

In the writing period of the second SF, sustain electrodes SU1 to SUn are applied with voltage Ve2, and scan electrodes SC1 to SCn are once held at voltage Vc. As described earlier, voltage Ve2 is set lower than voltage Ve3, and is set about 5V lower than voltage Ve3 in the present embodiment.

Voltages other than the voltage applied to sustain electrodes SU1 to SUn are equal to the voltages applied in the first SF. More specifically, of data electrodes D1 to Dm, data electrode Dk (k=1 to m) of the discharge cell that is to emit light on the first row is applied with write pulse voltage Vd, and scan electrode SC1 on the first row is applied with scan pulse voltage Va. Thus, the writing discharge is generated in the discharge cell that is to emit light on the first row, thereby performing a writing operation to accumulate a wall voltage on each electrode. The above-described writing operation is applied to the discharge cells row by row up on the nth row so as to terminate the writing period.

In the subsequent sustain period, the same operations as in the sustain period of the first SF are performed except for the number of the sustain pulses, so that the description will not be repeated.

In the subsequent third to tenth SFs, the initialization period is identical to the initialization period of the first and second SFs. In the writing period, sustain electrodes SU1 to SUn are applied with voltage Ve2 in the same manner as in the second SF so as to perform a writing operation. In the sustain period, the same sustain operation as in the sustain period of the first SF is performed except for the number of sustain pulses.

Figure 5:
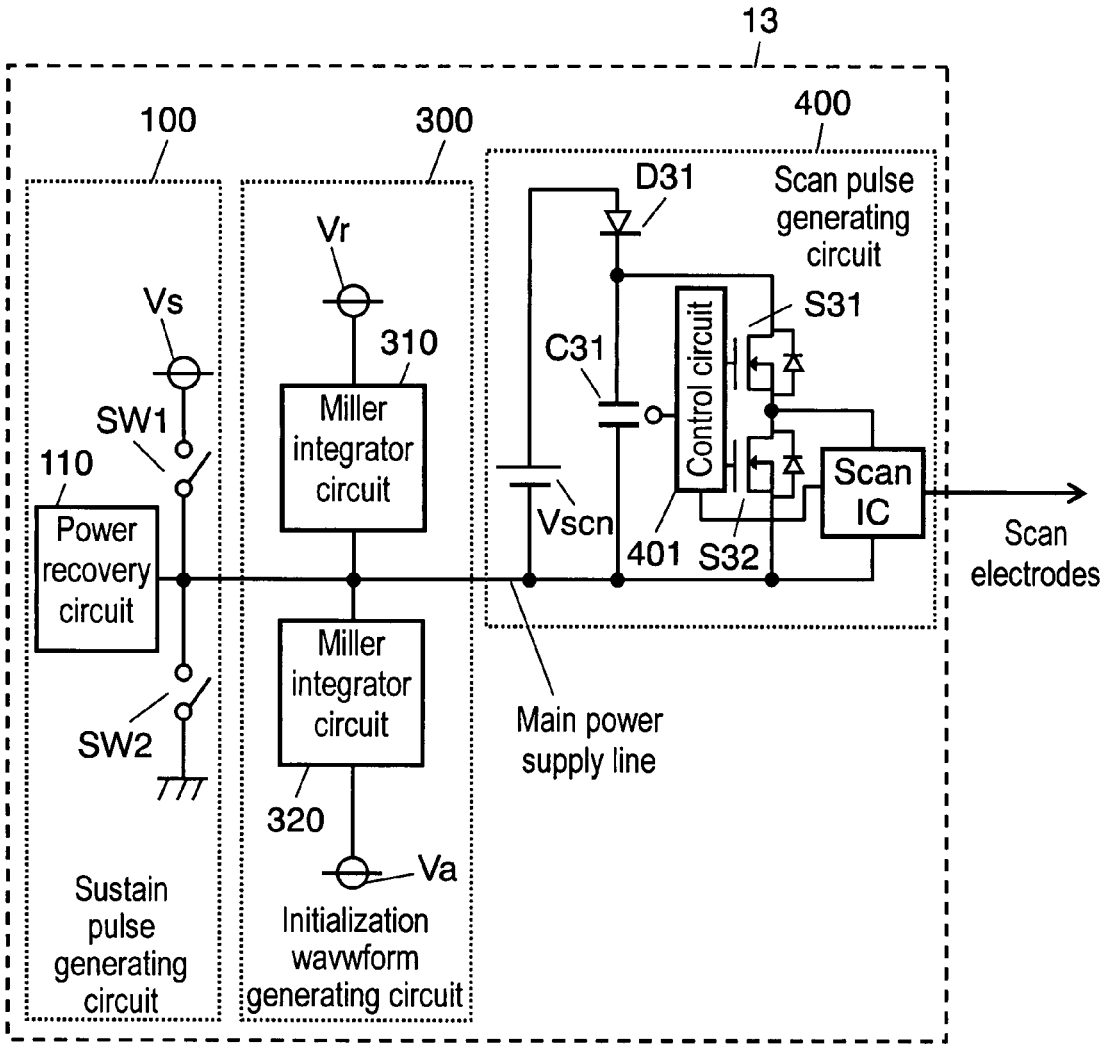
FIG. 5 is a circuit diagram of scan electrode driving circuit 13 according to the embodiment.

The following is a detailed description of scan electrode driving circuit 13, sustain electrode driving circuit 14, and data electrode driving circuit 12, and their operations. FIG. 5 is a circuit diagram of scan electrode driving circuit 13 according to the embodiment. Scan electrode driving circuit 13 includes sustain pulse generating circuit 100 generating sustain pulses, initialization waveform generating circuit 300 generating initialization waveforms, and scan pulse generating circuit 400 generating scan pulses. Sustain pulse generating circuit 100 includes power recovery circuit 110, switching element SW1, and switching element SW2 so as to generate sustain pulse voltage Vs. Power recovery circuit 110 recovers the power used to drive scan electrodes 4 for recycling. Switching element SW1 clamps scan electrodes 4 to voltage Vs, and switching element SW2 clamps scan electrodes 4 to 0V.

Initialization waveform generating circuit 300 includes Miller integrator circuits 310 and 320 so as to generate the aforementioned initialization waveforms. Miller integrator circuit 310 includes a FET, a capacitor, and a resistor so as to generate a ramp voltage gradually increasing to reach voltage Vi2. Miller integrator circuit 320 includes a FET, a capacitor, and a resistor so as to generate a ramp voltage gradually decreasing to reach voltage Vi4.

Scan pulse generating circuit 400 includes switching elements S31 and S32, a Scan IC, control circuit 401, diode D31 for backflow prevention, and capacitor C31. Control circuit 401 selects between the following two voltages and applies the selected voltage to scan electrodes 4. One of the two voltages is applied to a power supply line which is commonly connected to sustain pulse generating circuit 100, initialization waveform generating circuit 300, and scan pulse generating circuit 400 and hereinafter abbreviated as a "main power supply line". The other voltage is obtained by superimposing voltage Vscn on the voltage of the main power supply line. In the writing period, for example, the voltage of the main power supply line is held at negative voltage Va. Then, control circuit 401 switches between voltage Va inputted to the Scan IC and voltage Vc obtained by superimposing voltage Vscn on voltage Va and outputs the selected voltage, thereby generating the aforementioned negative scan pulse voltage Va. The time required for the switching can be controlled to change the pulse width of scan pulse voltage Va.

Scan pulse generating circuit 400 outputs the voltage waveforms of initialization waveform generating circuit 300 without change in the initialization period and also outputs the voltage waveforms of sustain pulse generating circuit 100 without change in the sustain period. The aforementioned switching elements S31, S32 and the Scan IC are made of MOSFET or other well-known elements for switching operations. The switching is controlled based on a control signal from control circuit 401 which is controlled by the timing signal outputted from timing generating circuit 15.

Figure 6:
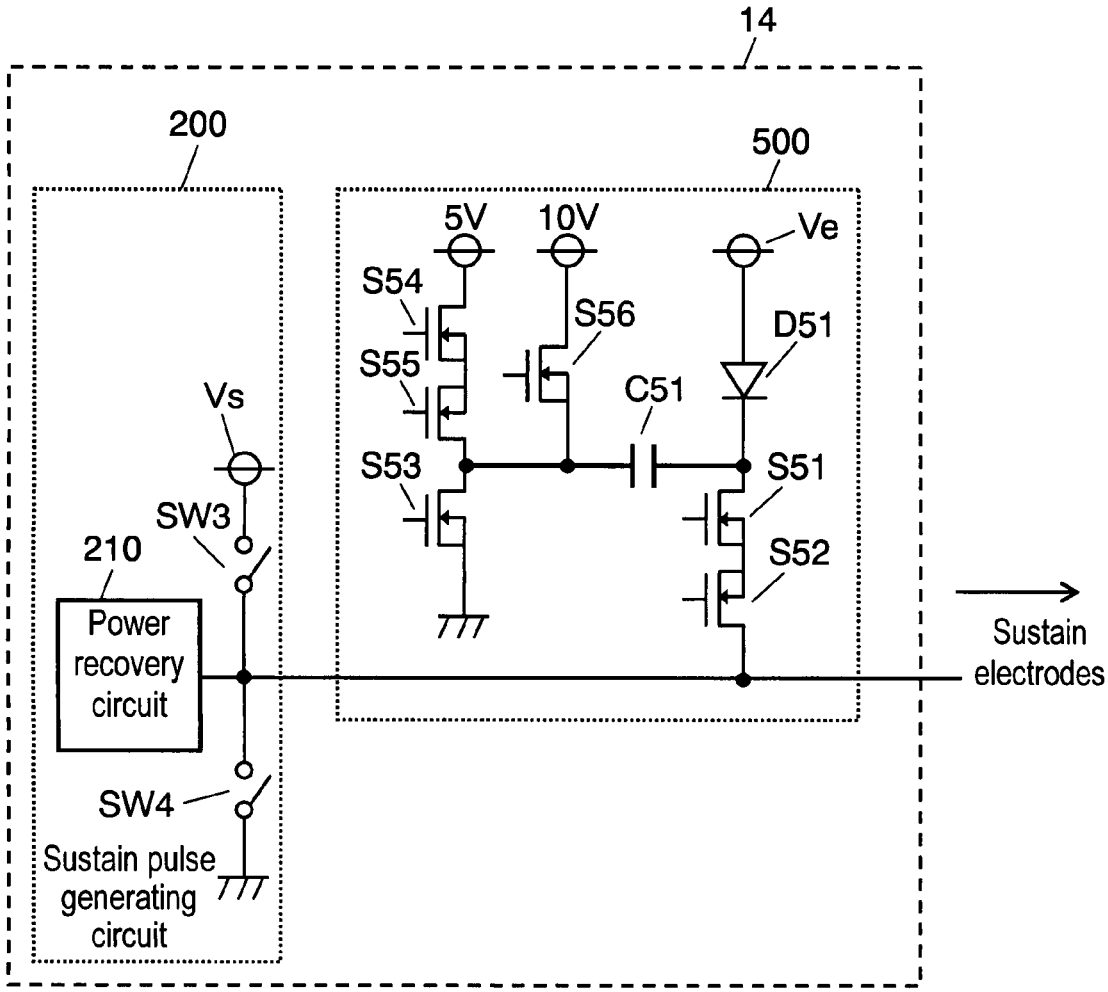
FIG. 6 is a circuit diagram of sustain electrode driving circuit 14 according to the embodiment.

FIG. 6 is a circuit diagram of sustain electrode driving circuit 14 according to the embodiment. Sustain electrode driving circuit 14 includes sustain pulse generating circuit 200 generating sustain pulses, and Ve voltage generating circuit 500 generating voltages Ve1, Ve2, and Ve3. Sustain pulse generating circuit 200 has the same structure as sustain pulse generating circuit 100 shown in FIG. 5. More specifically, sustain pulse generating circuit 200 includes power recovery circuit 210, switching element SW3, switching element SW4 so as to generate sustain pulse voltage Vs. Power recovery circuit 210 recovers the power used to drive sustain electrodes 5 for recycling. Switching element SW3 clamps sustain electrodes 5 to voltage Vs, and switching element SW4 clamps sustain electrodes 5 to 0V.

Ve voltage generating circuit 500 includes: switching elements S51 and S52 for applying voltage Ve1 to sustain electrodes 5; diode D51 for backflow prevention; switching element S53 for charging voltage Ve1 to capacitor C51; switching elements S54 and S55 for generating voltage Ve2; and switching element S56 for generating voltage Ve3. Turning on switching element S53 allows voltage Ve1 to be charged to capacitor C51. When sustain electrodes 5 are applied with voltage Ve1, switching elements S51 and S52 are turned on so as to connect sustain electrodes 5 to the power supply of voltage Ve1. When sustain electrodes 5 are applied with voltage Ve2, switching element S53 is turned off and switching elements S54 and S55 are turned on to superimpose voltage Ve1 of capacitor C51 on 5V, thereby generating voltage Ve2. When sustain electrodes 5 are applied with voltage Ve3, switching element S53 is turned off and switching element S56 is turned on so as to superimpose voltage Ve1 of capacitor C51 on 10V, thereby generating voltage Ve3.

As described hereinbefore, in the circuit structure used in the present embodiment, sustain electrodes SU1 to SUn are applied with voltage Ve2 or Ve3 using voltage Ve1 and a power supply of 5V or 10V. However, this is not the only circuit structure that can be used in the present invention. Alternatively, for example, voltages Ve1, Ve2, and Ve3 can be formed independently of each other so as to be applied to sustain electrodes 5.

Figure 7:
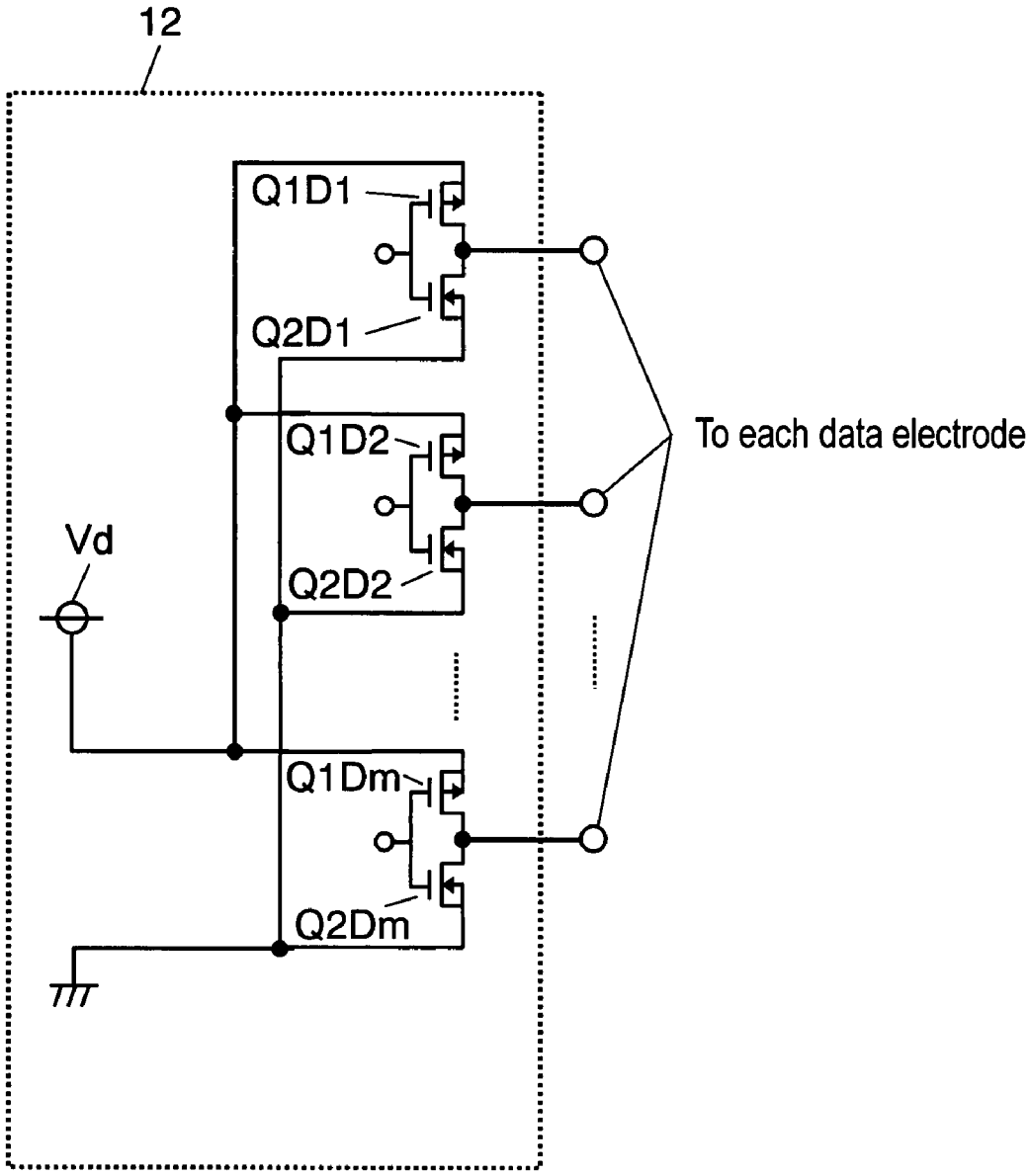
FIG. 7 is a circuit diagram of data electrode driving circuit 12 according to the embodiment.

FIG. 7 is a circuit diagram of data electrode driving circuit 12 according to the embodiment. Data electrode driving circuit 12 includes switching elements Q1D1 to Q1Dm and switching elements Q2D1 to Q2Dm. In data electrode driving circuit 12, data electrodes 9 are independently clamped to voltage Vd via switching elements Q1D1 to Q1Dm and independently grounded and clamped to 0V via switching elements Q2D1 to Q2Dm. In this manner, data electrode driving circuit 12 drives each data electrode 9 independently of the others to apply positive write pulse voltage Vd thereto.

The following is a description of why voltage Ve3 to be applied to the sustain electrodes in the writing period of the first SF having the lowest display luminance is set higher than voltage Ve2 to be applied to the sustain electrodes in the writing period of the subsequent sub fields.

As described earlier, each subfield is set to have a luminance weight not higher than the luminance weight of the subfield arranged later. In the present embodiment, later subfields are set to have higher luminance weights. The first SF has a luminance weight of "1", which indicates the lowest display luminance in charge of displaying the level value having the smallest gradation difference. As a result, the first SF tends to have both discharge cells to be lit (hereinafter abbreviated as "cells-to-be-lit") and discharge cells not to be lit (hereinafter abbreviated as "cells-not-to-be-lit") at random. In this case, the cells-to-be-lit are highly likely surrounded by cells-not-to-be-lit. Such cells-to-be-lit are hereinafter abbreviated as "isolated cells-to-be-lit". Applying error diffusion or dithering causes both cells-to-be-lit and cells-not-to-be-lit present at random or regularly in the first SF, making it highly likely for the cells-to-be-lit to become isolated cells-to-be-lit.

When performing a writing operation, these isolated cells-to-be-lit cannot receive priming due to a writing discharge from adjacent discharge cells because there are no cells-to-be-lit in vicinity that have performed a writing operation immediately before. In the conventional driving method, such a situation often causes an increase in the discharge delay of these isolated cells-to-be-lit. The increased discharge delay can make the wall voltage accumulated by a writing discharge too small to generate a sustain discharge in the subsequent sustain period. The increased discharge delay may even prevent the generation of a writing discharge, causing the isolated cells-to-be-lit to become unlit cells.

In the present embodiment, on the other hand, voltage Ve3 to be applied to the sustain electrodes in the writing period of the first SF is set high enough to facilitate the generation of a writing discharge. This ensures the generation of a writing discharge even by isolated cells-to-be-lit, thereby preventing the generation of the unlit cells.

Needless to say, setting voltage Ve3 to be applied to the sustain electrodes high leads to the following problem. It becomes easier to generate a writing discharge, and therefore more discharge cells that should not emit light generate a writing discharge and emit light in a sustain period (hereinafter abbreviated as "cells-to-be-erroneously-lit"). The inventors of the present invention, however, have found from detailed analysis that such cells-to-be-erroneously-lit are caused only in cells-to-be-lit that have too much priming. More specifically, the discharge cells lit in the tenth SF easily become cells-to-be-erroneously-lit in the first SF. The discharge cells lit in the ninth SF but not in the tenth SF are less likely to become cells-to-be-erroneously-lit in the first SF. The discharge cells lit in the eighth SF but not in the ninth and tenth SFs are much less likely to become cells-to-be-erroneously-lit in the first SF. The discharge cells lit in the fifth SF but not in the sixth to tenth SFs do not become cells-to-be-erroneously-lit in the first SF.

The reason for this seems to be as follows. The tenth SF has a luminance weight of "80", which is the largest of all the subfields and produces a large volume of priming in the discharge cells where a sustain discharge has been generated. Before such priming is attenuated, the writing operation of the first SF is started. Therefore, setting voltage Ve3 to be applied to the sustain electrodes high facilitates the generation of the writing discharge. As a result, the discharge cells that have not even been applied with a write pulse generate a writing discharge and become cells-to-be-erroneously-lit. On the other hand, the discharge cells lit in the fifth SF but not in the six to tenth SFs do not become cells-to-be-erroneously-lit probably because of the following reasons. The luminance weight of the fifth SF is as small as "11", and most of the priming is attenuated during the sufficient time between the sustain period of the fifth SF and the writing period of the first SF. As described hereinbefore, setting voltage Ve3 to be applied to the sustain electrodes in the writing period of the first SF may cause cells-to-be-erroneously-lit, but such cells-to be-erroneously-lit have turned out to be caused only in discharge cells that display high gradation levels. On the other hand, as well known, the brightness that a human can sense is logarithmic with respect to the luminance. Therefore, even if more cells-to-be-erroneously-lit are generated in a region that is displayed with high luminance so as to slightly increase the luminance, there is hardly any influence on display images.

As described hereinbefore, facilitating the generation of a writing discharge in the writing period of the subfield having the lowest display luminance can reduce the probability of unlit cells when displaying low gradation levels, and have excellent display quality.

The present embodiment describes that voltage Ve3 to be applied to the sustain electrodes in the writing period of the subfield having the lowest display luminance is set higher by 5V than voltage Ve2 to be applied to the sustain electrodes in the writing period of the other subfields. However, this is not the only voltage difference that can be used in the present invention, and an optimum voltage difference can be set in accordance with the characteristics of discharge or the like of the panel. However, a voltage difference of less than 2V is too small to exert the effect of the present invention. On the contrary, a voltage difference of 10V or more is not preferable because it increases the probability of cells-to-be-erroneously-lit. In conclusion, the voltage difference between Ve3 and Ve2 is preferably set in the range of 2V to 10V.

Each subfield is set to have a luminance weight not higher than the luminance weight of the subfield arranged later in the present embodiment. However, the present invention has no limitations with respect to the number of subfields or the luminance weight of each subfield. The present invention can be applied, for example, to the case where one field is divided into 12 subfields (the first SF, the second SF, . . . , and the 12th SF) consisting of two or more sub field groups in each of which the luminance weight increases such as 1, 2, 4, 8, 16, 32, 56, 4, 12, 24, 40, and 56, respectively.

The present invention, which provides a method for driving a panel that has a low probability of unlit cells when displaying low gradation levels and has excellent image display quality, is useful as a method for driving a plasma display panel and as a plasma display device.

The invention claimed is:

1. A method for driving a plasma display panel comprising discharge cells at intersections of a data electrode and a pair of a scan electrode and a sustain electrode, wherein one field period is composed of a plurality of subfields, each subfield of the plurality of subfields including a writing period during which a writing discharge is generated in a selected discharge cell of the discharge cells, and a sustain period during which a sustain discharge is generated in the selected discharge cell, wherein the method for driving the plasma display panel comprises:

applying a first voltage to be applied to the sustain electrode for a whole duration of the writing period of a subfield, of the plurality of subfields, having a lowest display luminance; and applying a second voltage for a whole duration of the writing period of respective subfields, of the plurality of subfields, other than the subfield having the lowest display luminance, and wherein the first voltage is higher than the second voltage.

2. A plasma display device comprising:

a plasma display panel having discharge cells at intersections of a data electrode and a pair of a scan electrode and a sustain electrode;

a data electrode drive circuit for supplying a driving signal to the data electrode;

a scan electrode drive circuit for supplying a driving signal to the scan electrode;

a sustain electrode drive circuit for supplying a driving signal to the sustain electrode; and a timing generation circuit for generating timing signals, wherein each of the data electrode drive circuit, the scan electrode drive circuit and the sustain electrode drive circuit generates a respective driving signal, wherein one field period is composed of a plurality of subfields, each subfield of the plurality of subfields including a writing period during which a writing discharge is generated in a selected discharge cell of the discharge cells, and a sustain period during which a sustain discharge is generated in the selected discharge cell, wherein the sustain electrode drive circuit is configured to (i) apply a first voltage to the sustain electrode for a whole duration of the writing period of a subfield, of the plurality of subfields, having a lowest display luminance, and (ii) apply a second voltage for a whole duration of the writing period of respective subfields, of the plurality of subfields, other than the subfield having the lowest display luminance, and wherein the first voltage is higher than the second voltage.

* * * * *